US007852366B2

(12) United States Patent
Iftime et al.

(10) Patent No.: US 7,852,366 B2
(45) Date of Patent: Dec. 14, 2010

(54) SYSTEM AND METHOD FOR PRINTING REIMAGEABLE TRANSIENT DOCUMENTS

(75) Inventors: Gabriel Iftime, Mississauga (CA); Eric J. Shrader, Palo Alto, CA (US); Peter M. Kazmaier, Mississauga (CA); Paul F. Smith, Oakville (CA); Hadi K. Mahabadi, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 853 days.

(21) Appl. No.: 11/762,327

(22) Filed: Jun. 13, 2007

(65) Prior Publication Data

US 2008/0310869 A1 Dec. 18, 2008

(51) Int. Cl.
*B41J 15/10* (2006.01)
*B41J 29/16* (2006.01)
*B41J 2/435* (2006.01)

(52) U.S. Cl. ..... 347/262; 347/171; 347/179; 347/224; 347/225; 347/232; 347/233; 347/238; 347/248; 347/263; 347/264; 430/19

(58) Field of Classification Search ..... 347/179, 347/262, 263, 264; 430/19
See application file for complete search history.

(56) References Cited

U.S. PATENT DOCUMENTS

| | | | |
|---|---|---|---|
| 3,825,427 | A | 7/1974 | Inoue et al. |
| 3,877,941 | A | 4/1975 | Lohmann |
| 3,961,948 | A | 6/1976 | Saeva |
| 4,425,161 | A | 1/1984 | Shibahashi et al. |
| 4,598,035 | A | 7/1986 | Usami et al. |
| 4,659,649 | A | 4/1987 | Dickinson et al. |
| 4,931,337 | A | 6/1990 | Miyazaki et al. |
| 5,124,236 | A | 6/1992 | Yamaguchi et al. |
| 5,262,280 | A | 11/1993 | Knudsen et al. |
| 5,376,511 | A | 12/1994 | Tatezono et al. |
| 5,458,874 | A | 10/1995 | Pereira et al. |
| 5,677,107 | A | 10/1997 | Neckers |
| 5,691,100 | A | 11/1997 | Kudo et al. |
| 5,691,395 | A | 11/1997 | Knudsen et al. |
| 5,710,420 | A | 1/1998 | Martin et al. |

(Continued)

FOREIGN PATENT DOCUMENTS

| | | | |
|---|---|---|---|
| CA | 2 053 094 | A1 | 4/1992 |

(Continued)

OTHER PUBLICATIONS

Non-Final Rejection for U.S. Appl. No. 11/762,152, mailed Mar. 23, 2010.

(Continued)

*Primary Examiner*—Ryan Lepisto
(74) *Attorney, Agent, or Firm*—Oliff & Berridge, PLC

(57) ABSTRACT

A system and a method print one or more images to one or more reimageable documents, wherein the one or more representative of at least a portion of a digital file. The method includes a connecting a portable printer to a computing device. Moreover, the method includes emitting ultraviolet light from a light source, wherein an imaging layer of the reimageable document is imagable by ultraviolet light, wherein ultraviolet light forms a color contrast on the imaging layer that defines an image representative of at least a portion of the digital file.

19 Claims, 4 Drawing Sheets

U.S. PATENT DOCUMENTS

| | | | | |
|---|---|---|---|---|
| 5,747,225 | A | 5/1998 | Manico et al. | |
| 6,067,185 | A | 5/2000 | Albert et al. | |
| 6,103,378 | A | 8/2000 | Yao et al. | |
| 6,200,646 | B1 | 3/2001 | Neckers et al. | |
| 6,286,423 | B1 * | 9/2001 | McCue et al. | 101/128.4 |
| 6,528,221 | B2 | 3/2003 | Takezawa et al. | |
| 6,579,662 | B1 | 6/2003 | Zheng et al. | |
| 6,680,281 | B2 | 1/2004 | Tajiri et al. | |
| 6,761,758 | B2 | 7/2004 | Boils-Boissier et al. | |
| 6,851,366 | B2 * | 2/2005 | Gutfleisch et al. | 101/456 |
| 6,866,981 | B2 | 3/2005 | Furukawa et al. | |
| 6,867,408 | B1 | 3/2005 | Gu et al. | |
| 6,906,118 | B2 | 6/2005 | Goodbrand et al. | |
| 6,942,334 | B2 * | 9/2005 | Silverbrook et al. | 347/109 |
| 7,018,714 | B2 | 3/2006 | Kobayashi et al. | |
| 7,057,054 | B2 | 6/2006 | Irie et al. | |
| 7,166,420 | B2 * | 1/2007 | Chopra et al. | 430/339 |
| 7,195,802 | B2 | 3/2007 | Iftime et al. | |
| 7,205,088 | B2 | 4/2007 | Iftime et al. | |
| 7,214,456 | B2 | 5/2007 | Iftime et al. | |
| 7,229,740 | B2 | 6/2007 | Iftime et al. | |
| 7,256,921 | B2 | 8/2007 | Kumar et al. | |
| 7,332,257 | B2 | 2/2008 | Miyako et al. | |
| 7,381,506 | B2 | 6/2008 | Iftime et al. | |
| 7,432,027 | B2 * | 10/2008 | Chopra et al. | 430/19 |
| 7,441,887 | B2 | 10/2008 | Senga et al. | |
| 7,564,030 | B2 * | 7/2009 | Shrader et al. | 250/316.1 |
| 2002/0135788 | A1 * | 9/2002 | Arakawa et al. | 358/1.1 |
| 2002/0160318 | A1 | 10/2002 | Richter et al. | |
| 2003/0130456 | A1 | 7/2003 | Kim et al. | |
| 2005/0012998 | A1 | 1/2005 | Kumar et al. | |
| 2005/0244744 | A1 | 11/2005 | Kazmaier et al. | |
| 2005/0269556 | A1 | 12/2005 | Evans et al. | |
| 2006/0001944 | A1 | 1/2006 | Chopra et al. | |
| 2006/0014099 | A1 | 1/2006 | Faler et al. | |
| 2006/0222972 | A1 | 10/2006 | Chopra et al. | |
| 2006/0222973 | A1 | 10/2006 | Iftime et al. | |
| 2006/0236470 | A1 | 10/2006 | Sabnis et al. | |
| 2006/0251988 | A1 | 11/2006 | Iftime et al. | |
| 2006/0257785 | A1 | 11/2006 | Johnson | |
| 2007/0054215 | A1 | 3/2007 | Iftime et al. | |
| 2007/0072110 | A1 | 3/2007 | Iftime et al. | |
| 2007/0112103 | A1 | 5/2007 | Zhou et al. | |
| 2008/0311489 | A1 | 12/2008 | Kazmaier et al. | |
| 2008/0311490 | A1 | 12/2008 | Norsten et al. | |
| 2008/0311491 | A1 | 12/2008 | Iftime et al. | |
| 2008/0311492 | A1 | 12/2008 | Iftime et al. | |
| 2008/0311493 | A1 | 12/2008 | Norsten et al. | |
| 2008/0311494 | A1 | 12/2008 | Norsten et al. | |
| 2008/0311495 | A1 | 12/2008 | Norsten et al. | |
| 2008/0311519 | A1 | 12/2008 | Kazmaier et al. | |
| 2008/0311521 | A1 | 12/2008 | Kazmaier et al. | |

FOREIGN PATENT DOCUMENTS

| | | |
|---|---|---|
| DE | 29 06 193 A1 | 8/1980 |
| EP | 1 367 111 | 12/2003 |
| EP | 1 405 891 | 4/2004 |
| EP | 1 591 829 | 11/2005 |
| EP | 1 591 831 | 11/2005 |
| FR | 2774998 | 8/1999 |
| GB | 2 430 257 | 3/2007 |
| JP | 57-136645 | 8/1982 |
| JP | A-61-175087 | 8/1986 |
| JP | A-5-265129 | 10/1993 |
| JP | A-11-30835 | 2/1999 |
| JP | A 11-322739 | 11/1999 |
| JP | A 2000-256347 | 9/2000 |
| JP | A-2002-179672 | 6/2002 |
| JP | A-2002-240441 | 8/2002 |
| JP | A-2002-285146 | 10/2002 |
| JP | A-2003-255489 | 9/2003 |
| JP | A-2003-255490 | 9/2003 |
| JP | A-2004-039009 | 2/2004 |
| JP | A-2004-045037 | 2/2004 |
| JP | A-2004-091638 | 3/2004 |
| JP | A-2004-149501 | 5/2004 |
| JP | A-2004-256780 | 9/2004 |
| JP | A-2005-082507 | 3/2005 |
| JP | A-2005-250463 | 9/2005 |
| WO | WO 97/31033 | 8/1997 |
| WO | WO 00/016985 A1 | 3/2000 |
| WO | WO 2006/039130 A1 | 4/2006 |
| WO | WO 2007/105699 A1 | 9/2007 |
| WO | WO 2008/043853 A2 | 4/2008 |

OTHER PUBLICATIONS

Non-Final Rejection for U.S. Appl. No. 11/762,176, mailed Jun. 25, 2009.

O.M. Babeshko et al., "Spiro-2H-Oxocines", Khimiya Geterotsiklicheskikh Soedinenii, No. 11, pp. 1490-1492, Nov. 1976.

Samir Kumar Mandal et al., "Titanocene(III) mediated radical cyclizations of epoxides for the synthesis of medium-sized cyclic ethers", Tetrahedron, vol. 63, pp. 11341-11348, 2007.

U.S. Appl. No. 10/834,722, filed Apr. 29, 2004, Iftime et al.

U.S. Appl. No. 10/835,518, filed Apr. 29, 2004, Kazmaier et al.

U.S. Appl. No. 11/123,163, filed May 6, 2005, Iftime et al.

Sep. 9, 2009 European Office Action issued in European Application No. 08 155 98.3-1217.

Dec. 22, 2009 Office Action issued in U.S. Appl. No. 11/762,176.

M. Irie, "Diarylethense for Memories and Switches," Chem Reviews, 100, pp. 1685-1716 (2000).

Kentaro Morimitsu et al., "Dithienylethenes With a Novel Photochromic Performance," J. Org. Chem., vol. 67, pp. 4574-4578 (2002).

Masamitsu Shirai et al., "Photoacid and Photobase Generators: Chemistry and Applications to Polymeric Materials," *Prog. Polym. Sci*. vol. 21, pp. 1-45 (1996).

T. Hirose et al., "Self-Assembly of Photochromic Diarylethenes With Amphiphilic Side Chains: Reversible Thermal and Photochemical Control," J. Org. Chem., 71, pp. 7499-7508 (2006).

T. Norsten et al., "Photoregulation of Fluorescence in a Porphyrinic Dithienylethene Photochrome," J. Am. Chem. Soc., 123(8), pp. 1784-1785 (2001).

Vladimir I. Minkin, "Photo-, Thermo-, Solvato-, and Electrochromic Spiroheterocyclic Compounds," Chemical Reviews, 104, 5, pp. 2751-2776 (2004).

Takayuki Suzuki et al., "Stabilization of the merocyanine form of photochromic compounds in fluoro alcohols is due to a hydrogen bond", Chem. Commun., 2685-2686 (1998).

Ronald F.M. Lange et al., "Supramolecular polymer interactions based on the alternating copolymer of styrene and Maleimide" Macromolecules, 28, 782-783 (1995).

Vladimir I. Minkin et al., "Perimidine spirocyclohexa dienones" in Organic Photochromic and Thermochromic Compounds, V1, Plenum Press, pp. 315-340 (1999).

John Biteau et al., "Photochromism of Spirooxazine-Doped Gels," J. Phys. Chem., 100, 9024-9031 (1996).

Leonard J. Prins et al., "Noncovalent Synthesis Using Hydrogen Bonding," Angew. Chem. Int. Ed., 40, 2382-2426 (2001).

Terry M. Cresp et al., "A Synthesis of αβ-Unsaturated Aldehydes," J. Chem. Soc., Perkin Trans., 1, pp. 37-41 (1974).

Elliot Berman et al., "Photochromic Spiropyrans. I. The Effect of Substituents on the Rate of Ring Closure," J. Am. Chem. Soc., 81, 5605-5608 (1959).

Sheng-Hua Liu et al., "Synthesis of Negative Photochromic Crowned Spirobenzopyrans," Syn. Commun., 30, 5, 895-902 (2000).

Yu M. Chunaev et al., "Reaction of the Fischer Base With Nitro- and Bromo-Substituted αHydroxycinnamaldehydes," Chem. Heterocycl. Compd., 628-631 (1984).

Kentaro Morimitsu et al., "Thermal Cycloreversion Reaction of a Photochromic Dithienylperfluorocyclopentene with *tert*-Butoxy Substituents at the Reactive Carbons," The Chemical Society of Japan, 2002, p. 572-573.
"Dolch Introduces World's First Ruggedized Notebook with Integrated Printer" available at http://news.thomasnet.com/fullstory/7005/447, pp. 1-4, Feb. 6, 2002.
U.S. Appl. No. 11/762,152, filed Jun. 13, 2007, Iftime et al.
U.S. Appl. No. 11/762,327, filed Jun. 13, 2007, Iftime et al.
U.S. Appl. No. 11/762,147, filed Jun. 13, 2007, Iftime et al.
U.S. Appl. No. 11/762,098, filed Jun. 13, 2007, Iftime et al.
U.S. Appl. No. 11/762,157, filed Jun. 13, 2007, Iftime et al.
U.S. Appl. No. 11/762,153, filed Jun. 13, 2007, Iftime et al.
U.S. Appl. No. 11/762,144, filed Jun. 13, 2007, Kazmaier et al.
U.S. Appl. No. 11/762,150, filed Jun. 13, 2007, Norsten et al.
U.S. Appl. No. 11/762,107, filed Jun. 13, 2007, Iftime et al.
U.S. Appl. No. 11/762,176, filed Jun. 13, 2007, Norsten et al.
U.S. Appl. No. 11/762,307, filed Jun. 13, 2007, Norsten et al.
U.S. Appl. No. 11/762,159, filed Jun. 13, 2007, Kazmaier et al.
U.S. Appl. No. 11/762,311, filed Jun. 13, 2007, Kazmaier et al.

* cited by examiner

SYSTEM AND METHOD FOR PRINTING REIMAGEABLE TRANSIENT DOCUMENTS

TECHNICAL FIELD

This disclosure is generally directed to a system and a method having an integrated tonerless printer for writing one or more images on reimageable paper, reimageable transient documents or image forming media. More particularly, in embodiments, this disclosure is directed to an integrated tonerless printer for forming images to reimageable transient documents by exposing an imaging layer to a UV light produced by a light source. UV light causes the imaging layer to exhibit a reversible or irreversible transition between a colored state and a clear state to form one or more images in the reimageable transient documents. The portion of the imaging layer exposed to UV light may remain in the colored state for a duration of time to produce transient documents.

After expiration of the duration, the portion of the imaging layer in the colored state may move to the clear state for erasing the one or more images therefrom the surface of the transient documents. With the imaging layer of the reimageable transient documents in the clear state, the transient documents may be inserted into the integrated tonerless printer to have other images formed or written thereon via UV light. Alternatively, the integrated tonerless printer may have an erasing mechanism for changing the imaging layer from the colored state to the clear state before expiration of the duration. As a result, a user of the may write to and may re-image transient documents without utilizing developer units having toner particles or numerous page of printable media along with the portable computer.

CROSS-REFERENCE TO RELATED APPLICATIONS

Disclosed in commonly assigned U.S. Patent Publication No. US 2006-0251988 A1, filed May 6, 2005, is an image forming medium, comprising a polymer, a photochromic compound containing chelating groups embedded in the polymer, and a metal salt, wherein molecules of the photochromic compound are chelated by a metal ion from the metal salt.

Disclosed in commonly assigned U.S. Patent Publication No. US 2005-0244744 A1, filed Apr. 29, 2004, is an image forming method comprising: (a) providing a reimageable medium comprised of a substrate and a photochromic material, wherein the medium is capable of exhibiting a color contrast and an absence of the color contrast; (b) exposing the medium to an imaging light corresponding to a predetermined image to result in an exposed region and a non-exposed region, wherein the color contrast is present between the exposed region and the non-exposed region to allow a temporary image corresponding to the predetermined image to be visible for a visible time; (c) subjecting the temporary image to an indoor ambient condition for an image erasing time to change the color contrast to the absence of the color contrast to erase the temporary image without using an image erasure device; and (d) optionally repeating procedures (b) and (c) a number of times to result in the medium undergoing a number of additional cycles of temporary image formation and temporary image erasure.

Disclosed in commonly assigned U.S. Patent Publication No. US 2005-0244743 A1, filed Apr. 29, 2004, is a reimageable medium comprising: a substrate; and a photochromic material, wherein the medium is capable of exhibiting a color contrast and an absence of the color contrast, wherein the medium has a characteristic that when the medium exhibits the absence of the color contrast and is then exposed to an imaging light corresponding to a predetermined image to result in an exposed region and a non-exposed region, the color contrast is present between the exposed region and the non-exposed region to form a temporary image corresponding to the predetermined image that is visible for a visible time, wherein the medium has a characteristic that when the temporary image is exposed to an indoor ambient condition for an image erasing time, the color contrast changes to the absence of the color contrast to erase the temporary image in all of the following: (i) when the indoor ambient condition includes darkness at ambient temperature, (ii) when the indoor ambient condition includes indoor ambient light at ambient temperature, and (iii) when the indoor ambient condition includes both the darkness at ambient temperature and the indoor ambient light at ambient temperature, and wherein the medium is capable of undergoing multiple cycles of temporary image formation and temporary image erasure.

Disclosed in commonly assigned U.S. Pat. No. 7,229,740, issued Jun. 12, 2007, is an image forming medium, comprising: a substrate; and an imaging layer comprising a photochromic material and a polymer binder coated on said substrate, wherein the photochromic material exhibits a reversible homogeneous-heterogeneous transition between a colorless state and a colored state in the polymer binder.

Disclosed in commonly assigned U.S. Pat. No. 7,381,506, issued Jun. 3, 2008, is an image forming medium, comprising: a substrate; and a mixture comprising a photochromic material and a solvent wherein said mixture is coated on said substrate, wherein the photochromic material exhibits a reversible homogeneous-heterogeneous transition between a colorless state and a colored state in the solvent.

Disclosed in commonly assigned U.S. Patent Publication No. US 2006-0222973 A1, filed Mar. 20, 2005, is a reimageable medium, comprising: a substrate having a first color; a photochromic layer adjacent to the substrate; a liquid crystal layer adjacent to the photochromic layer, wherein the liquid crystal layer includes a liquid crystal composition; and an electric field generating apparatus connected across the liquid crystal layer, wherein the electric field generating apparatus supplies a voltage across the liquid crystal layer.

Disclosed in commonly assigned U.S. Patent Publication No. US 2005-0244742 A1, filed Apr. 29, 2004, is a reimageable medium for receiving an imaging light having a predetermined wavelength scope, the medium comprising: a substrate; a photochromic material capable of reversibly converting among a number of different forms, wherein one form has an absorption spectrum that overlaps with the predetermined wavelength scope; and a light absorbing material exhibiting a light absorption band with an absorption peak, wherein the light absorption band overlaps with the absorption spectrum of the one form.

The entire disclosure of the above-mentioned applications are totally incorporated herein by reference.

BACKGROUND

Portable devices, such as, for example, cellular phones, laptops, PDAs and the like are utilized on a regular and daily basis by mobile workers to transmit communications between coworkers, clients, employers and the like, to maintain business schedules, to manage activities and to access and view business associated files. As a result, these portable devices have allowed the mobile workers to work from remote locations with respect to places of employment. Allowing mobile workers to work from remote locations has caused an increase in demand for portable devices having displays to allow the mobile workers to access and to view documents, electronic files and the like.

Portable devices with displays are useful for increasing the mobility of the mobile workers by allowing the mobile workers to view important information or data that may be included within documents and electronic files. The mobile workers may retrieve the documents or the electronic files from storage devices of the portable devices and may view the documents or the electronic files via the one or more displays for the portable devices. However, current displays often have poor readability or visibility for the documents or the electronic files. The poor readability of displays for the portable devices is due to poor resolution in display screens and poor brightness with respect to surrounding environments. Typically, display screens for portable devices have a resolution of about 100 dpi.

Printable media, such as, for example, sheets of paper, exhibit a higher readability than the readability of display screens associated with portable devices. Traditionally, images printed onto printable media have a resolution of at least double the resolution of display screens, for example of about 600 dpi or more, which is superior to the resolution associated with display screens. Thus, mobile workers are able to view documents and the like printed onto printable media with greater clarity than documents that are viewed only on display screens of portable devices.

However, physically printing documents with a portable device is presently problematic. The portable devices must connect to a printer that is stationary with respect to a physical location, such as a computer lab, an internet café, a printing shop and the like. Thus, to print images of documents or the digital files that may be accessed and displayed by the portable device, the mobile worker must either relocate to the physical location and connect the portable device to the printer, or must print to a remote location and then retrieve the prints having the images thereon from the printer. These activities that must be completed by the mobile workers to print to the printable media greatly reduces the mobility and the productivity of the mobile workers.

Alternatively, a portable device may have an integrated toner printer associated therewith. Such printers require developer units, such as, for example, toner cartridges, for the printer and large quantities of printable media for receiving images associated with the documents or the digital files from the printer. Most printers require at least four developer units to print or to write colored images onto the printable media. Each developer unit for the printer increases the overall weight of the portable device and the integrated printer. Additionally, the requirement of large quantities of printable media for printing images further increases the overall weight required to move and utilize the portable device and the printer. As the overall weight of the printer and the large quantities of printable media increases, the usefulness of the printer decreases, and the mobile workers bypass such printers and simply accept the low resolution of the screen display. Moreover, as the overall weight increases, utilizing the portable device with the printer becomes inconvenient, burdensome and difficult.

A need, therefore, exists for a system and a method for printing reimageable transient documents from a tonerless printer integrated with a portable device that increases mobility and the efficiency in printing images for greater image resolution. Moreover, a need exists for a system and a method for printing a large number of pages for a document with a smaller number of reimageable transient documents via the tonerless printer.

SUMMARY

The present disclosure addresses these and other needs, in embodiments, by providing a system for printing an image to a document. The system has a portable computing device having a central processing unit, wherein the central processing unit accesses at least one digital file. Further, the system has a printer connected to the central processing unit, wherein the printer is integrated into the portable computing device, wherein the central processing unit transmits a digital signal to the printer, wherein the digital signal is representative of one or more images associated with at least a portion of a digital file, wherein the printer has a light source that emits ultraviolet light indicative of the digital signal received from the central processing unit. Still further, the system has a reimageable document positionable adjacent to the light source. The reimageable document has a substrate and an imaging layer comprising an imaging material, wherein the imaging layer is coated on the substrate, wherein the imaging material exhibits a reversible transition between a clear state and a colored state. Moreover, the imaging layer is imagable by the ultraviolet light emitted from the light source, wherein the ultraviolet light moves a first portion of the imaging material from the clear state to the colored state, and wherein the first portion corresponds to the image associated with at least a portion of the digital file.

According to aspects illustrated herein, there is provided a system for printing one or more images to one or more reimageable documents, wherein an image is representative of at least a portion of a digital file, wherein the digital file is accessible by a central processing unit. The system has a reimageable document having an imaging layer made of an imaging material wherein the imaging material exhibits a reversible transition between a clear state and a color state. Further, the system has a portable printer connectable to the central processing unit, wherein the portable printer receives a digital signal from the central processing unit, wherein the digital signal is representative of a portion of the digital file. The printer has a light source capable of emitting ultraviolet light toward the imaging layer of the reimageable document, wherein a portion of the imaging layer is imagable by ultraviolet light emitted from the light source. Moreover, the portion of the imaging layer is movable from the clear state to the color state by ultraviolet light and forms a color contrast on the imaging layer, wherein the color contrast defines an image that is representative of the portion of the digital file.

In embodiments, provided is a method for printing one or more images to one or more reimageable documents, wherein the one or more images are representative of at least a portion of a digital file. The method includes connecting a portable printer to a computing device. Moreover, the method includes emitting ultraviolet light from a light source, wherein an imaging layer of the reimageable document is imagable by ultraviolet light, wherein ultraviolet light forms a color contrast on the imaging layer that defines an image representative of at least a portion of the digital file.

It is, therefore, an advantage of the various embodiments described herein to provide a system and a method for printing reimageable transient documents which exhibit an increased readability when compared to readability of a display screen from a computing device. Another advantage of the various embodiments is to provide a system and a method for printing reimageable transient documents which may be viewed as a permanently printed document to decrease operation time of a computing device. Yet another advantage of the various embodiments is to provide a system and a method for printing reimageable transient documents which increases portability of the documents and a computing device that produces the documents. A further advantage of the various embodiments is to provide a system and a method for printing reimageable transient documents that re-uses and re-images the documents numerous times to display more than one image representative of digital files. Moreover, another advantage of the various embodiments is to provide a system and a method for printing reimageable transient documents that eliminates a burden of changing toner or ink cartridges and reduces wasted paper sheets while providing high quality printed media.

EMBODIMENTS

Figure 1:
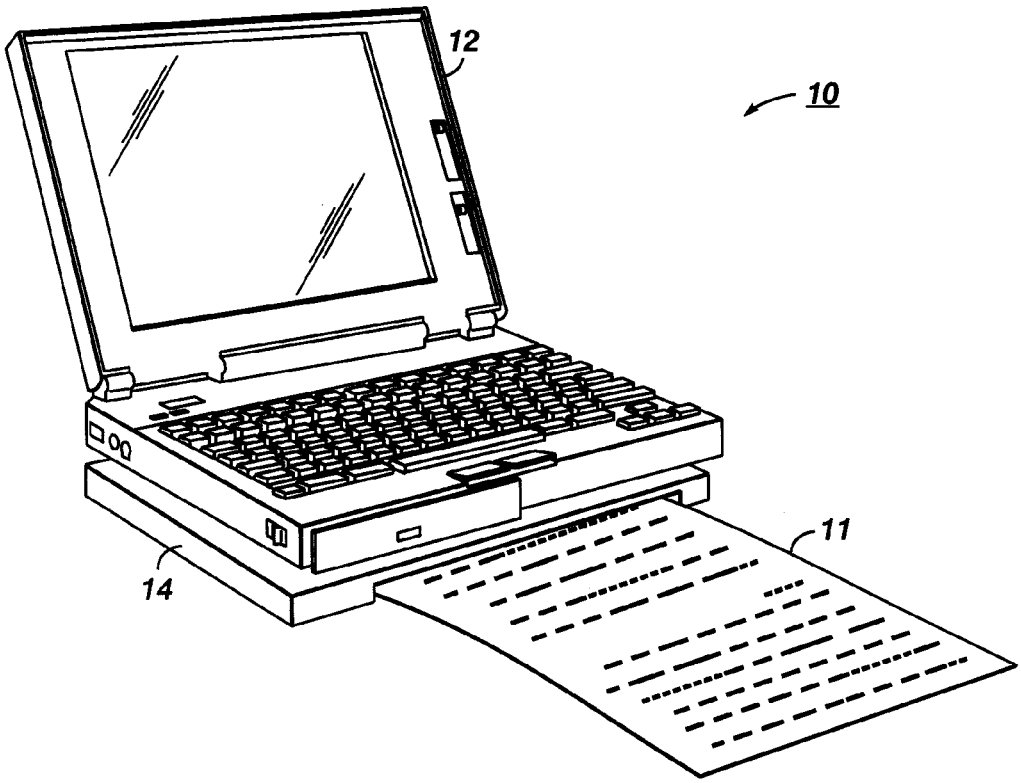
FIG. 1 illustrates a perspective view of a system for printing reimageable paper in an embodiment of the present disclosure.

Generally, in various exemplary embodiments, there is provided a portable computing device having an integrated tonerless printer for writing or printing images associated with at least one digital file stored within or displayed by the portable computing device to reimageable transient documents. In other embodiments, there is provided a portable tonerless printer that may be connected to a computing device for writing or printing images associated with the digital files stored within or displayed by the computing device. The tonerless printer exposes areas corresponding to the image to be printed, of the reimageable transient documents to UV light from a light source within the tonerless printer. The reimageable transient documents may be covered by or may be coated with a composition to form an imaging layer. The imaging layer may be made of a photochromic compound, where the photochromic compound exhibits a reversible transition between a colored state and a clear state.

A user may write or may print the images directly to the reimageable transient documents from a portable computing device or from any other type of device containing printable files. The images may be displayed on the reimageable transient documents for a temporary period of time or permanently. The images may fade from or may be erased from the reimageable transient documents, and new images may be formed on the reimageable transient documents. As a result, the user may be capable of viewing any number of images by re-writing or re-imaging new images onto the reimageable transient documents. The images formed on the reimageable transient documents may be displayed in a higher resolution via the reimageable transient documents than a resolution of a display screen of a portable computing device.

In embodiments, the portable computing device may be a mobile computer, such as, for example a laptop computer, a notebook computer or the like. The portable computing device may be any computing device that may be capable of being configured and integrated with the tonerless printer, such as, for example, a subnotebook, a personal digital assistant, a portable data terminal, a mobile data terminal, a tablet personal computer, a smartphone, a wearable computer or the like. The term "mobile computer" refers to any computing device that has the ability to use 'untethered' technology, that is not physically connected, or in remote, mobile or non-static environments. Further, the term "mobile computer" refers to any computing device that may be connected wirelessly to and through the internet or to and through a private network. Still further, the tonerless printer is most suitable used in conjunction with the mobile computer, but utility of the tonerless printer is not limited thereto. In embodiments, the tonerless printer is used in conjunction with non-mobile computers, such as, for example desktop computers and the like.

In embodiments, the reimageable transient documents may include a media substrate for receiving the imaging layer or a photochromic compound. The media substrate may be made from paper or plastic or any suitable coatable material. The imaging layer may be applied to or may cover the media substrate to form a medium for displaying at least one transient image or at least one permanent image. In embodiments, the imaging layer may be applied to or may cover a first side of the media substrate to form a single-sided reimageable transient document for writing and for printing a transient image or a permanent image thereon. In embodiments, the imaging layer may be applied to or may cover the first side of the media substrate and a second side of the media substrate to form a double-sided reimageable transient document for writing and for printing transient images or permanent images thereon.

In embodiments, the media substrate may be made from a porous paper, a coated paper or a photographic paper. The porous paper may be advantageous because a coating from a solution for the photochromic film may provide a media substrate that may be coated on the first side and the second side of the media substrate in one-step coating process.

The imaging layer may include any suitable material that, when exposed to an activating energy such as ultraviolet light, may switch or may move between a clear state and a colored state via, for example, an isomerization reaction. The color state may be reversed, and thus the image "erased" and the reimageable transient document returned to a clear state, by various means such as heating or visible light. The composition may be heated to a temperature that reverses the isomerization reaction, thus returning the photochromic material to a clear state. In the colored state, the image may remain visible for a period of time, such as, for example, twenty hours, two days or indefinitely.

In embodiments, any suitable composition may be used for forming the transient imaging layer. For example, a photochromic material, such as spiropyran, is known in the art, and described in various of the above-referenced related applications. The composition may also include other materials that may exhibit the desired state change, such as UV-activated dyes, UV-activated acids and bases, UV-activated imines or amines, UV-activated functionalized fulgicides and dithienylethenes, UV-activated ionomeric compounds, and the like, including combinations thereof. The composition for the imaging layer may be dispersed in any suitable medium for forming the imaging layer, such as being dispersed in a solvent, a solution, a polymer binder, or the like; may be chemically bonded to a carrier such as a polymer binder; may be provided in the form of microencapsulated materials; and may be incorporated in an enclosed matrix to hold the imaging composition in place; and the like.

In embodiments, the photochromic material may be any suitable photochromic material that may be useful in providing reimageable transient documents including, for example, organic photochromic materials. Examples of photochromic materials may include spiropyrans and related compounds like spirooxazines and thiospiropyrans, benzo and naphthopyrans (chromenes), stilbene, azobenzenes, bisimidazols, spirodihydroindolizines, quinines, perimidinespirocyclohexadienones, viologens, fulgides, fulgimides, diarylethenes, hydrazines, anils, aryl disulfides, aryl thiosulfonates and the like. In the aryl disulfides and aryl thiosulfonates, suitable aryl groups include phenyl, naphthyl, phenanthrene, anthracene, substituted groups thereof, and the like. These materials may variously undergo heterocyclic cleavage, such as spiropyrans and related compounds; may undergo homocyclic cleavage such as hydrazine and aryl disulfide compounds; may undergo cis-trans isomerization such as azo compounds, stilbene compounds and the like; may undergo proton or group transfer phototautomerism such as photochromic quinines; and may undergo photochromism via electro transfer such as viologens and the like.

In embodiments, the imaging layer may include or a composition containing a precursor that generates an amine when exposed to UV light and an acid-base indicator, such as, for example phenolphthalein for writing permanent images without using ink or toner. The amine may react with the acid-base indicator to produce a specific coloration that is different for the initial color to create a stable and permanent image. In embodiments, the acid-base may be, for example Methyl violet, thymol blue, methyl yellow, bromphenol blue, methyl orange, methyl red, litmus, bromthymol blue, phenol red, phenolphthalein, thymolphthanein and alizarim yellow. Gray levels of a color may be obtained by controlling the pH of the areas exposed to UV light. The acid-base indicator may change to various colors, as a function of the pH by controlling the amount of photogenerated amine to create multicolor images.

In other embodiments, the imaging layer may include a composition having an amine photogenerator, a coupling agent like for example an aldehyde, a polymer binder and a solvent in a solvent for writing permanent images without using ink or toner. Writing is performed by exposing a portion of the imaging layer to UV light to produce an amine. The document may be heated to a temperature greater than 100° C. As a result, the amine may react with the coupling agent causing a color change at the exposed portion for forming a color contrast between exposed portion and remaining unexposed portions.

In embodiments, the imaging layer may include a composition having charged ionomers or ion containing polymers as components in the polymeric binder of transient documents to provide a more polar/ionic medium for which to stabilize the colored-ionic state. For example, polyanions such as polystyrene sodium sulfonate or polycations such as poly(diallyldimethylammonium chloride) may provide complimentary charge stabilization of the merocyanine state. Writing may be performed by UV light and the writing may have a longer image lifetime than a standard transient document lifetime due to the stabilizing effects mentioned above. Erasing the image may be achieved by applying heat to the document. However, the increased stability of the colored state may require elevated temperatures, longer heat times or a combination of both to erase or decolorize the media.

In embodiments, the imaging layer may include a composition having a photochromic polymer that is thermally stable, such as, for example diarylethene and fulgide photochromic materials. The photochromic polymer may be dispersed in a polymeric binder material. Writing to the documents may be performed by exposing a portion of the documents to UV light simultaneously with heating from a heating mechanism. Writing on the document may have a long image lifetime, such as, for example several days when the document is maintained at ambient conditions. The writing within the portions of the documents may be erased by exposing those areas to normal or high intensity visible light simultaneous, optimally with heating from a heating mechanism.

In the imaging layer of embodiments, the photochromic material is converted from a clear state to a colored state by the application of suitable energy, such as the application of ultraviolet light. The reimageable transient document may be erased by heating or by illumination with visible light of an appropriate wavelength. An advantage of embodiments, however, is that the photochromic material does not revert to the colorless state at room temperature or under normal ambient light. As a result, the colored form of the photochromic material, and thus the visible image, remains stable and visible for longer periods of time, for example from above two days to indefinitely.

In embodiments where the photochromic material for the imaging layer may be coated on the substrate, coating of the substrate may be conducted by any suitable method available in the art, and the coating method is not particularly limited. For example, the imaging material may be coated on the substrate by dip coating the substrate into a solution of the imaging material composition followed by any necessary drying, or the substrate may be coated with the material to form the imaging layer thereof. A protective coating may be applied by similar methods.

Imaging light used to form the images on the imaging layer of the reimageable transient documents may have any suitable predetermined wavelength scope such as, for example, a single wavelength or a band of wavelengths. In embodiments, the imaging light may be UV light having a single wavelength or a narrow band of wavelengths selected from the UV light wavelength range of about 200 nm to about 475 nm, such as a single wavelength at about 365 nm or a wavelength band of from about 360 nm to about 370 mm. For forming the image, the reimageable medium may be exposed to the imaging light for a time period ranging from about 10 milliseconds to about 5 minutes, particularly from about 30 milliseconds to about 1 minute. The imaging light may have an intensity ranging from about 0.1 $mW/cm^2$ to about 100 $mW/cm^2$, particularly from about 0.5 $mW/cm^2$ to about 10 $mW/cm^2$.

In embodiments, UV light corresponding to an image may be generated by, for example a computer or a Light Emitting Diode (LED) array screen and the transient or permanent image may be formed on the reimageable transient document by placing the reimageable transient document on or in proximity to the LED array screen for a duration of the time period. The LED array screen may also be referred to as a UV LED print bar. In other embodiments, a UV Raster Output Scanner (ROS) may be used to generate the UV light in an image-wise pattern. Other suitable imaging techniques that may be used include, but are not limited to, irradiating a UV light onto the image forming medium through a mask, irradiating a pinpoint UV light source onto the image forming medium in an imagewise manner such as by use of a light pen, a stylus, and the like.

To form or to write the images on the imaging layer, a portion of the imaging layer may be exposed to UV light. The UV light may be representative of one or more images. The portion of imaging layer may exposed to UV light that corresponds to one or more images. UV light may move the portion of the imaging layer from the clear state to the colored state. After exposure to UV light, the portion of the imaging layer in the colored state may correspond to one or more images. As a result, the portion of the imaging layer in the colored state may form a transient image corresponding to one or more images associated with the UV light.

To erase the transient image in one embodiment, the reimageable transient document bearing the image may be subjected to, for example an ambient condition for the transient period of time to switch from the colored state to the clear state. Thus, the image may be erased without using an erasing mechanism, and the image is visible only for the transient period of time sufficient for the user to view the transient image, but the period of time may also be limited to allow the user to repeat the writing or imaging procedures for image formation and image erasure any number of times.

As such, the reimageable transient document may undergo a number of cycles of image formation and image erasure. For example, the reimageable transient document may undergo image formation and image erasure from about 2 to thousands and perhaps millions, of times, such as from about 2 or about 1,000,000 or about 2 to about 100,000 or about 10,000 or more times. The reimageable transient document may be considered "self-erasing." However, because the colored form of the photochromic material of the imaging layer may be stable in embodiments, this self-erasure under ambient conditions may take from about twelve hours to as long as about two weeks or more.

In other embodiments, where faster erasure is desired so that a new image formation may be formed, erasure may be conducted by heating the reimageable transient document to an elevated temperature or by exposing the reimageable transient document to visible light from an erasing mechanism. For example, heating can be conducted at a temperature from about 50 to about 500° C., such as from about 100 to about 200° C., to enable erasure of the image.

The erasing light used to remove or to erase the transient image from the imaging layer of the reimageable transient documents may have any suitable predetermined wavelength scope such as, for example, a single wavelength or a band of wavelengths. In embodiments, the erasing light may be visible light having a single wavelength or a narrow band of wavelengths selected from the visible light wavelength range.

The color contrast that renders the image visible to an observer may be a contrast between, for example two, three or more different colors. The term "color" may encompass a number of aspects such as hue, lightness and saturation, where one color may be a different color than another color if the two colors may differ in at least one aspect. For example, two colors having the same hue and saturation but may be different in lightness may be considered different colors. Any suitable colors such as, for example, red, white, black, gray, yellow, cyan, magenta, blue, and purple, may be used to produce a color contrast as long as the image is visible to a naked eye of the user.

In embodiments, the following exemplary color contrasts may be used: purple temporary image on a white background; yellow temporary image on a white background; dark purple temporary image on a light purple background; and light purple temporary image on a dark purple background. For maximizing color contrast, a desirable color contrast may be a dark gray or black image on a light or white background, such as a gray, dark gray, or black images on a white background, or a gray, dark gray, or black image on a light gray background. The color contrast may change or may diminish during a visible time, but the phrase "color contrast" may encompass any degree of color contrast sufficient to render an image discemable to the user regardless of whether the color contrast may change or may remain constant during the visible time.

In embodiments, the imaging layer may be overcoated by a protective layer, which may protect the transient image displayed on the reimageable transient document against UV light, such as ambient light or sun light. The protective layer may be made of a dipolar molecule that may be reversibly switched between a UV light transmission state and a UV light absorption state by applying an electric field. The protective layer can also include, as with the imaging layer, a suitable solvent, polymer, encapsulations, or the like, for holding the dipolar molecules in place. The protective layer may protect the transient document against undesired image degradation due to ambient UV light. The protective layer may be optically clear and transparent in both states with the electric field ON or OFF, so that the transient image may be written on the underlying imaging layer when the electric field is ON, and the transient image may be viewed through the protective layer when the electric field is OFF.

Referring now to the drawing wherein like numerals refer to like parts, FIG. 1 illustrates a system 10 for writing or for printing one or more transient images onto an image layer of one or more reimageable transient documents 11 (hereinafter "document 11" or "documents 11"). In embodiments, the system 10 may write or may print one or more images onto documents 11.

The system 10 may have a portable computing device 12 with an integrated tonerless printer 14 (hereinafter "printer 14"). Tonerless refers to printing or imaging on a medium without transferring toner particles or developer material to the medium. The portable computing device 12 may have a CPU 16 for operating and controlling the printer 14 to write or to print the images onto imaging layers of the documents 11.

In embodiments, the system 10 may be configured such that the printer 14 may be positioned underneath or adjacent to a bottom side of the portable computing device 12. Alternatively, the system 10 may be configured such that the printer 14 may be positioned adjacent to a rear side of the portable computing device 12. An advantage of system 10 may be that the printer 14 is integrated with the portable computing device 12. As a result, the system 10 include a portable computing device and printing station to be utilized by a mobile worker or a user that remote with respect to a stationary computing system. It should be understood that the configuration of the printer 14 and the integrated portable computing device 12 of the system 10 may be any configuration that conveniently and efficiently integrates the printer 14 with the portable computing device 12 as known to one skilled in the art.

The CPU 16 may be operatively connected to or in common with the printer 14. The portable computing device 12 may have output devices (not shown in the figures), input devices (not shown in the figures) and a user interface (not shown in the figures) for operating or manipulating the CPU 16. One of the output devices may be a display screen for displaying one or more images associated with one or more digital files that may be stored within or accessed by the CPU 16 of the portable computing device 12. The images may be visual representations of the one or more digital files and may be displayed on the display screen of the portable computing device 12 in a first resolution, such as, for example 100 dots per inch (hereinafter "dpi"), 200 dpi or 300 dpi.

A number of documents 11 may be stored within or may be housed within an area associated with the printer 14. In embodiments, the printer 14 may have a storage area 13 formed therein. The printer 14 may be sized and may be shaped to receive the documents 11 for storing or housing the documents. As a result, the number of documents 11 may be stored or may be housed within the storage area 13 of the printer 14. In embodiments, the number of documents 11 which may be stored within the storage area 13 may be, for example, one (1) to about twenty (20), fifty (50) or less than about one hundred (100). It is desirable to maintain the size of the storage area 13 too as small as possible, and thus to minimize the number of reimageable sheets.

The printer 14 may have a ultraviolet light source 17 (hereinafter "UV source 17"), a scanning mechanism 18 and/or an erasing mechanism 20 therein. The CPU 16 of the portable computing device 12 may be operatively connected to or in communication with the UV source 17, the scanning mechanism 18 and the erasing mechanism 20. As a result, the CPU 16 may operate or may control the UV source 17, the scanning mechanism 18 and the erasing mechanism 20. The CPU 16 may activate or may deactivate at least one of the UV source 17 and the erasing mechanism 20 to write images to the documents 11 or to erase images from the documents 11, respectively. The CPU 16 may activate the scanning mechanism 18 to create one or more digital files based on or corresponding to images of the documents 11.

The CPU 16 may activate the UV source 17 to emit UV light for writing or for printing one or more images representative of the one or more digital files onto one or more documents 11. The CPU 16 may deactivate the UV source 17 to prevent or to terminate writing. In embodiments, the UV source 17 may be a portable UV light source device, such as, for example, a UV light emitting diode print bar (hereinafter "LED print bar"). The LED print bar may be sized and shaped to be integrated within the printer 14. The LED print bar may emit UV light at the first UV light wavelength range. Alternatively, the UV source 17 may be, for example a UV raster output scanner or the like.

The UV source 17 may be positioned within the printer 14 such that the UV source 17 is directed toward the imaging layer of the documents 11. The CPU 16 may transmit a signal or a command to the UV source 17 that is indicative of or digitally representative of at least one image associated with at least one digital file. The digital file may be accessible or may be retrievable by the CPU 16. The UV source 17 may produce or may emit UV light corresponding to or indicative of the signal and the image associated with the digital file.

UV light from the UV source 17 may be directed toward at least one portion of the imaging layer on at least document 11 to switch or to move photochromic material within that portion of the imaging layer between a clear state and a colored state via the isomerization reaction. The portion of the imaging layer switched to the colored state via the UV light may correspond to the at least one image of the at least one digital file. A color contrast may be defined by the portion of the imaging layer that is in the colored state in view of the remaining area of the imaging layer that is in the clear state. The color contrast formed on the imaging layer of the document 11 may form or may define the image associated with the digital file that is displayed by or is viewable via the document 11. As a result, the document 11 may display at least one image associated with at least one digital file that may be accessible via the CPU 16 of the portable computing device 12.

With the imaging layer in the colored state, the photochromic compound may display at least one image in a single color, multiple colors, gray scale colors and the like. As a result, the color contrast defined by the portion of the imaging layer of the documents 11 in the colored state may display the images representative of the digital file in a single color, in multiple colors, in gray levels, with a brightness or in a second resolution. The brightness associated with the portion of the document may depend upon an intensity of UV light emitted thereon by the UV source 17 or the duration of time that imaging layer of the document 11 is exposed to UV light emitted thereon by the UV source 17.

The CPU 16 may be programmed to control a brightness for images associated with the portion of the imaging layer in the colored state by increasing or decreasing the intensity of UV light emitted thereon or the duration of time that UV light is emitted thereon. The image written onto the image layer of the document 11 may have a greater brightness than images displayed on the display screen of the portable computing device 12. As a result, the image written onto the image layer of the document 11 may be clearer or more visible than the image displayed on the display screen of the portable computing device 12.

In embodiments, the second resolution for the image displayed on the document 11 via the imaging layer may be greater than the first resolution for the image displayed on the display screen of the portable computing device 12. In embodiments, the second resolution for the imaged displayed on the document 11 may be at least 400 dpi, may exceed 600 dpi or may be about 1200 dpi. As a result, the image displayed on the image layer of the document 11 in the second resolution may be clearer or visible than the image displayed via the display screen in the first resolution.

The printer 14 may have a paper transfer mechanism 22 for ejecting or dispensing one or more documents 11 that display the at least one image associated with the at least one digital file from the printer 14. After the at least one image is framed on the imaging layer of at least one document 11 via the UV source 17, the at least one document 11 is removed from or is transferred from the printer 14 to the user via a slot (not shown in the drawings) that may be formed in a housing of the printer 14 and/or the portable computing device 12. The user may retrieve the at least one document 11 from the slot. As a result, the document 11 may be portable with respect to the portable computing device 12 for reviewing by the user, for presentation to others or modification by the user. Moreover, the user may be capable of creating the document 11 with the image mobility from the portable computing device 12 without having to access a remote network, a network printer or a printing establishment.

In embodiments, the system 10 may have a stylus 24 for modifying, for revising or for editing at least one document 11 that was retrieved from the portable computing device 12. The portable computing device 12 or the printer 14 may have a compartment for receiving and for storing the stylus 24. The stylus 24 may have a light source mounted thereon for emitting UV light in a second UV light wavelength range to write onto the image layer of the document 11. The second UV light wavelength range may be similar to or may be the same as the UV light wavelength range of UV light emitted by the UV source 17.

UV light in the second UV light wavelength range emitted from the stylus 24 may switch other portions of the image layer from the clear state to the colored state to add a written image to the image layer of the document. The other portions of the image layer in the colored state written by UV light from the stylus 24 may modify or may change the color contrast thereon of the imaging layer in the colored state. As a result, the other portions may define or may form at least one written image on the imaging layer of the document 11 to modify or to edit the document 11. The written image added to the image layer by UV light emitted from the stylus 24 may be formed by an isomerization reaction that may be similar to the isomerization reaction that formed the image representative of the digital file on the image layer. The written image may be a transient image or may be a permanent image that may fade away by the expiration of the transient period of time or may be displayed indefinitely, respectively.

At the expiration of the transient period of time, the written portion may switch from the colored state to the clear state via the isomerization of the imaging layer of the document 11. As a result, the color contrast visible on the imaging layer of the document 11 may disappear or may fade away after the expiration of the transient period of time. On the imaging layer, the image formed by the UV source 17 or the written image formed by the stylus 24 may disappear or may fade away by the expiration of the transient period. As a result, the document 11 may become blank and/or the color contrast may not exist by the expiration of the transient period.

The blank document 11 may be inserted into the slot of the printer 14 or the portable computing device 12. The document 11 may be transferred into the storage area 13. As a result, the document 11 may be stored within the storage area 13 for re-imaging or by the printer 14. During re-imaging, a portion of the document 11 may be re-exposed to UV light as described above and may display other images indicative of or representative of the same digital file or other digital files that are accessible by or displayed from the portable computing device 12. Imaging and re-imaging of the documents 11 by the printer 14 may allow the user to print and view images of one or more digital files without requiring the user to carry a large quantity of printable media, such as paper for imaging by the printer 14. As a result, the documents 11 and the printer 14 may increase mobility of and/or efficiency of a mobile worker or the user by allowing imaging and re-imaging the documents 11 to display images associated with one or more digital files.

The document 11 may display the image formed by the UV source 17 and/or the written images formed by the stylus 24 as set forth above. The document 11 may be inserted into the slot and may be transferred to the scanner mechanism 18 for imaging to create a digital image of the document 11. The scanner mechanism 18 may scan the document 11 and may create the digital image of the document 11. The digital image of the document 11 may be digitally formatted and transmitted to the CPU 16 of the portable computing device 12. The CPU 16 may store the digital image of the document 11 therein. As a result, the user may be capable of modifying the document 11 with the written images formed by the stylus 24 and storing a modified version of the document 11 within the CPU 16.

For example, the document 11 may display a permanent template, such as company letter head and a transient image representative of a digital file, such as a letter. The user may be required to add a signature to the document 11 prior to transmitting the document 11 to a third party. The user may retrieve the document with the permanent template and the transient image from the printer 14, may add the signature to the document 11 and may create a digital image of the document 11 via the scanning mechanism 18. The user may transmit the digital image of the document 11 to the third party via the portable computing device 12.

Prior to the expiration of the transient period of time, the user may desire to erase the image and/or the written images from the imaging layer of the document 11 to prepare the document 11 for re-imaging by the printer 14. The user may insert the document 11 into the slot for transferring the document 11 to the erasing mechanism 20 for erasing the image or the written images from the imaging layer of the document 11.

In embodiments, the erasing mechanism 20 may have a visual light source (hereinafter "VIS light source") or a heating source. The VIS light source may emit high intensity VIS light that is directed inwardly with respect to the imaging layer of the document 11. High intensity VIS light or the heating source may heat the imaging layer of the document 11 for erasing the images and/or the written images thereon. Alternatively, the erasing mechanism 20 may have a light source that may emit inferred (hereinafter "IR") light to heat the imaging layer of the document 11. The heat from the VIS light, the IR light or the heating source may heat the imaging layer to a temperature that reverses the isomerization reaction, thus returning the portion of the written images from the colored state to a clear state. As a result, the written images may be erased from the document 11 by heating the imaging layer of the document 11. Thus, the document 11 may be blank and may be ready for re-imaging by the printer 14.

The paper transfer mechanism 22 may move the blank or erased document 11 into the storage area 13 for storing the document 11 until the printer 14 is prepared to re-image the document 11 with other images associated with one or more documents. Alternatively, the paper transfer mechanism 22 may retrieve the document 11 from the erasing mechanism 20 and the UV source 17, and may emit UV light onto the imaging layer of the document 11 without moving the document 11 into the storage area 13. As a result, the document 11 may be erased by the erasing mechanism 20 and re-imaged by the UV source 17 in a single-pass. The re-imaged document 11 may be dispensed from the printer 14 via the paper transfer mechanism 22. One or more of the documents 11 may be imaged, erased and re-imaged more than one time to display any number of images associated with the one or more digital files.

Figure 3:
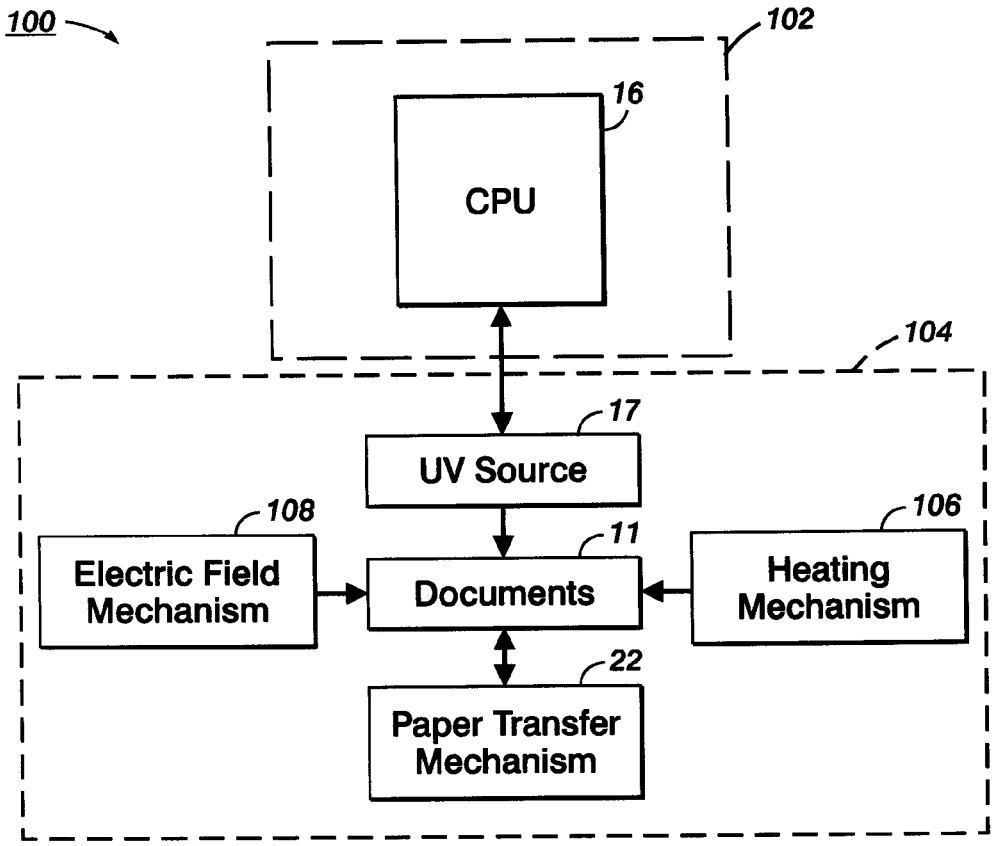
FIG. 3 illustrates a black box diagram of a system for printing reimageable paper in an embodiment of the present disclosure.

FIG. 3 illustrates a system 100 for writing one or more images to one or more of the documents 11. The system 100 may have a computing device 102 which may be connectable to a portable tonerless printer 104 (hereinafter "portable printer 104") for writing or for printing one or more images associated with one or more digital files stored within, accessed by or displayed by the computing device 102. The portable printer 104 may have a configuration that allows carrying or transporting the portable printer 104 to be convenient and non-burdensome. Additionally, the configuration of the portable printer 104 may be light-weight to increase portability of the portable printer 104 for use by a mobile worker or the user.

Figure 2:
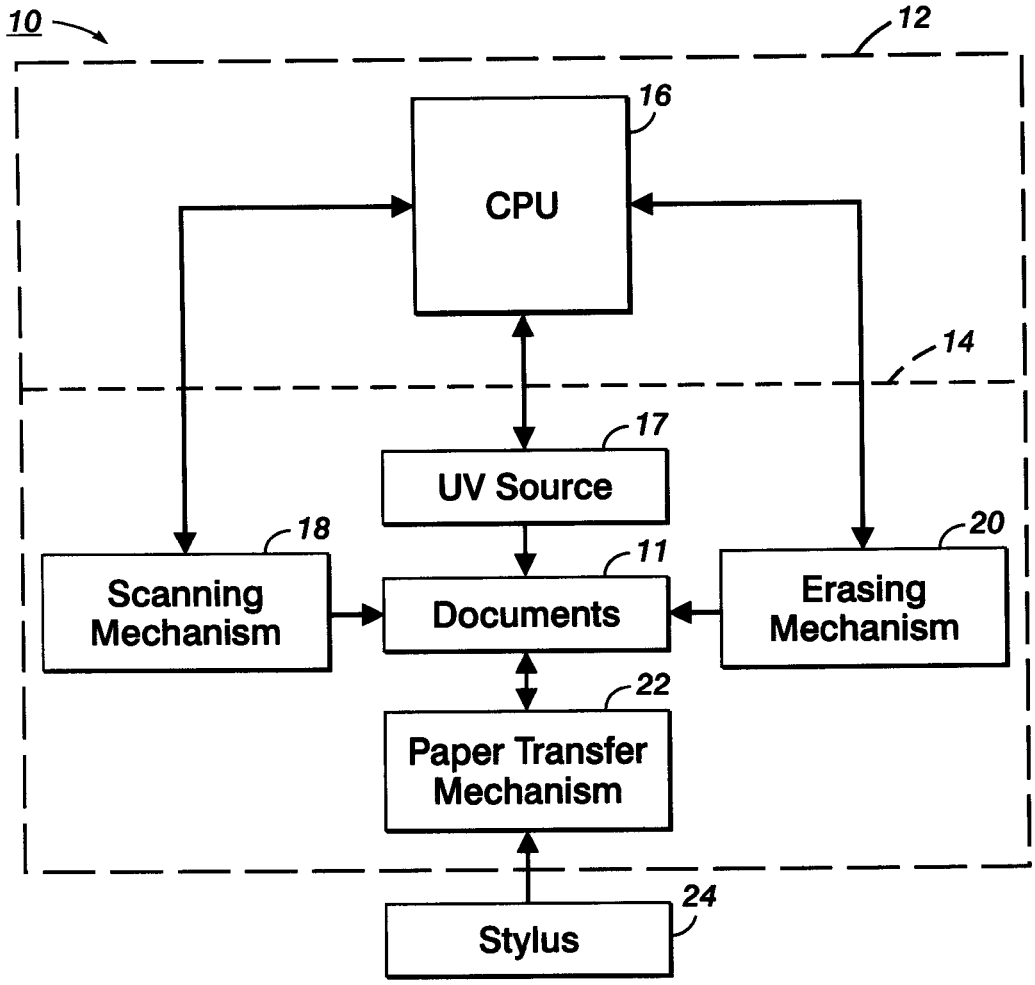
FIG. 2 illustrates a black box diagram of a system for printing reimageable paper in an embodiment of the present disclosure.

It should be understood that like number within FIG. 3 refer to like components in FIG. 2. The portable printer 104 may include a heating mechanism 106 and an electric field mechanism 108. The CPU 16 of the computing device 102 may be operatively connected to or in communication with the heating mechanism 106 and the electric field mechanism 108. One or more digital signal may be transmitted between the CPU 16 and the heating mechanism 106 or the electric field mechanism 108.

Similarly as described with respect to the printer 14, the portable printer 104 may form one or more images on the documents 11 by exposing one or more portions of the image layer of the documents 11 to UV light emitted from the UV source 107. As a result, the one or more portions may switch from the clear state to the colored state to form the color contrast for displaying the one or more images. The portable printer 104 may erase transient images by heating the imaging layer of the documents from heat emitted from the heating mechanism 106. As a result, the portion of the imaging layer may be switched from the colored state to the clear state to erase or to remove the color contrast or the one or more images from the imaging layer of the documents 11.

In embodiments, the documents stored in the storage area 13 of the portable printer 104 may have an imaging layer for writing permanent images without using ink or toner. The writing of permanent images may be performed by exposing one or more portions of the imaging layer of the document 11 to UV light to produce an amine within the imaging layer. The heating mechanism 106 may heat the document 11 to a color-changing temperature that is at least greater than 100° C. As a result, the amine formed within the imaging layer may react with a coupling agent that causes the portions of the imaging layer to switch from the clear state to the colored state for forming the color contrast between image and the non-imaged portions of the document 11.

For writing permanent images, the CPU 16 of the computing device 102 may transmit a digital signal to the UV source 17 to initiate writing of one or more images associated with or representative of one or more digital files. The UV source 17 may emit UV light onto a portion of the imaging layer of the document 11 that is indicative of one or more images associated with one or more digital files. The CPU 16 may transmit a signal to the heating mechanism 106 to initiate heating of the document 11. The heating mechanism 106 may heat the document 11 to at least the color-changing temperature for the imaging layer of the document 11. Alternatively, the UV source 17 may emit UV light and the heating mechanism 106 may emit heat simultaneously directed inwardly with respect to the portion of the imaging layer of the document 11. As a result, the portion of the imaging layer of the document 11 may switch from the clear state to the colored state to display the color contrast and the image representative of the digital file.

The portion of the imaging layer of the document 11 exposed to UV light and the heat may switch from the clear state to the colored state to form the color contrast and the image associated with the at least one digital file thereon. The document 11 having the image displayed thereon via the color contrast may be ejected or removed from the portable printer 104. The user may retrieve the document 11 from a slot of the portable printer 104 to view or to utilize one or more images formed thereon by the UV source 17 and the heating mechanism 106 of the portable printer 104.

In permanent imaging embodiments, the imaging layer in the colored state may be thermally stable to prevent the imaging layer from switching back to the clear state without being heated to a temperature greater than the color-changing temperature of the imaging layer. As a result, the image formed on the document 11 may be displayed indefinitely or permanently until heat is applied to the imaging layer of the document 11. The user may desire to erase or to clear the image from the imaging layer for reusing or for re-imaging the document 11.

The user may insert the document 11 into the slot for transferring the document 11 to the heating mechanism 106 for erasing the image or the color contrast displayed by the imaging layer of the document 11 via heating. The heating mechanism 106 may heat the imaging layer to a temperature that is greater than the color-changing temperature of the imaging layer. As a result, the portion of the imaging layer that forms the color contrast and the image may switch from the colored state to the clear state. Thus, the image and the color contrast displayed by the imaging layer may fade away or may disappear from the imaging layer of the document 11.

The paper transfer mechanism 22 may move the blank or erased document 11 to the storage area 13 for storage therein until a re-imaging process is initiated by the UV source 17. Alternatively, the document 11 may be positioned adjacent to the UV source 17 and may be exposed to UV light for re-imaging one or more images associated with one or more documents onto the imaging layer of the documents 11. As a result, the image displayed on the imaging layer of the document 11 may be erased by heating and the document 11 may be re-imaged by UV light emitted from the UV source 11 in a single-pass.

In embodiments, a protective layer, such as, for example a dipolar molecule dispersed in a polymeric binder may coat or may cover the imaging layer of the documents 11. The protective layer may prevent UV light from the entire UV spectrum from coloring unexposed portions of the documents 11 that remain in the clear state after writing by the portable printer 104. Before writing the image to the portion of the imaging layer, the electric field mechanism 108 may apply an electrical field to the protective layer to allow UV light from the UV source 17 to be emitted onto the imaging layer of the documents 11. After the portion of the imaging layer has been exposed to the UV light to form the image or the color contrast thereon, the electrical field from the electric field mechanism 108 may be removed and the protective layer may absorb UV from ambient light for preventing undesired coloration of unexposed portions of the imaging layer. Alternatively, the protective layer may contain electrodes at ends to allow a voltage to applied through these electrodes from the electric field mechanism 108 for writing onto the imaging layer of the documents 11.

The protective layer may protect the image formed on the imaging layer against UV light, such as ambient light or sun light. As a result, the protective layer may protect the documents 11 against undesired image degradation due to ambient UV light. In embodiments, the protective layer may be optically clear and transparent when the electrical field is being applied or is not being applied, so that the image may be written on the underlying imaging layer when the electrical field is being applied, and the image may be viewed by the user through the protective layer when the electrical field is not being applied. The paper transfer mechanism 22 may eject or may dispense the document 11 with the image formed on the imaging layer underneath the protective layer. The user may retrieve the document 11 from the paper transfer mechanism 22 via the slot of the portable printer 102.

The user may desire to erase the image or the color contrast formed on the imaging layer beneath the protective layer of the document 11. The user may insert the document 11 into the slot of the portable printer 104 and the document 11 may be moved to a position adjacent to the heating mechanism 106 and the electric field mechanism 108 for erasing the image and the color contrast from the imaging layer of the document 11. The electric field mechanism 108 may apply the electrical field to the protective layer so that the protective layer is not protecting the imaging layer from UV light or heat. The heating mechanism 106 may emit heat inwardly with respect to the document 11 as the electrical field is being applied by the electric field mechanism 108. As a result, the heat from the heating mechanism 106 may switch the portion of the imaging layer from the colored state to the clear state to erase the image or the color contrast therefrom. Thus, the image or the color contrast displayed on the imaging layer may fade away or may disappear from the imaging layer of the document 11.

The document 11 may be moved to the storage area 13 for storing the document 11 until the portable printer 104 may initiate re-imaging of the document 11. Alternatively, the document 11 may be positioned adjacent to the UV source 17 for re-imaging by the portable printer 104. The electric field mechanism 108 may apply the electrical field to the protective layer and the UV source 17 may emit UV light onto the document 11 for forming the image or the color contrast on the imaging layer of the document 11. As a result, the image formed on the document 11 may be erased and the document 11 may be reimaged in a single-pass.

Figure 4:
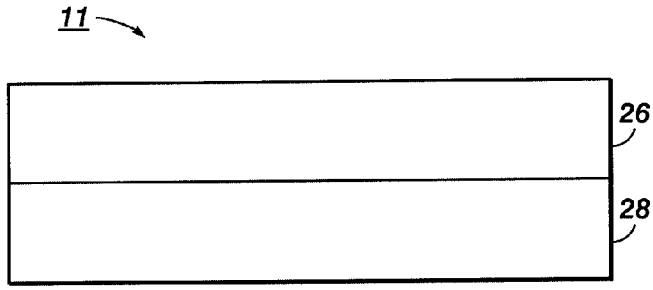
FIG. 4 illustrates a perspective view of the reimageable document in an embodiment of the present disclosure.

FIG. 4 illustrates a document 11 for writing or for printing one or more transient images. Document 11 includes imaging layer 26 and substrate 28. In embodiments, the system 10 may write or may print one or more images onto the imaging layer 26 of the document 11.

Many alternatives, modifications and variations of the exemplary embodiments will be apparent to those skilled in the art. For example, variations may involve different types, shapes and proportions of the main features of the described devices. Accordingly, the embodiments, as set forth above, are intended to be illustrative and not limiting. Various changes may be made without departing from the spirit and scope of the exemplary embodiments.

What is claimed is:

1. A system for printing an image to a document, the system comprising:

a portable computing device having a central processing unit, wherein the central processing unit accesses at least one digital file;

a printer connected to the central processing unit, wherein the printer is integrated into the portable computing device, wherein the central processing unit transmits a digital signal to the printer, wherein the digital signal is representative of one or more images associated with at least a portion of the at least one digital file, wherein the printer has a light source that emits ultraviolet light indicative of the digital signal received from the central processing unit;

a reimageable document positionable adjacent to the light source, wherein the reimageable document comprising:

a substrate; and an imaging layer comprising an imaging material, wherein the imaging layer is coated on the substrate, wherein the imaging material exhibits a reversible transition between a clear state and a colored state, wherein the imaging layer is imagable by the ultraviolet light emitted from the light source, wherein the ultraviolet light moves a first portion of the imaging material from the clear state to the colored state, and wherein the first portion corresponds to the image associated with at least a portion of the digital file; and a stylus emitting ultraviolet light, wherein a second portion of the imaging material is movable from the clear state to the colored state via ultraviolet light emitted from the stylus, wherein the second portion forms a written image on the imaging layer of the reimageable document.

2. The system according to claim 1, further comprising:

a scanning mechanism creating a digital file of the reimageable document wherein the digital file created by the scanning mechanism is accessible by the portable computing device.

3. The system according to claim 1, further comprising:

a storage area formed within the printer, wherein the storage area is sized to receive one or more reimageable documents.

4. The system according to claim 1, the printer further comprising:

an erasing mechanism emitting visible light with an appropriate wavelength toward the imaging layer of reimageable document, wherein the imaging material is movable from the clear state to the colored state by the visible light.

5. The system according to claim 1, the printer further comprising:

a heating source emitting heat toward the imaging layer of the reimageable document wherein the imaging layer is heated by the heat from the heating source, wherein the imaging material is movable between the clear state and the colored state by heat emitted from the heating source.

6. The system according to claim 1, the reimageable document further comprising:

a protective layer over or within the imaging layer, wherein the protective layer prevents ambient light from moving portions of the imaging layer from the clear state to the colored state.

7. A system for printing one or more images to one or more reimageable documents, wherein an image is representative of at least a portion of a digital file, wherein the digital file is accessible by a central processing unit, the system comprising:

a reimageable document having an imaging layer made of an imaging material wherein the imaging material exhibits a reversible transition between a clear state and a color state;

a portable printer connectable to the central processing unit, wherein the portable printer receives a digital signal from the central processing unit, wherein the digital signal is representative of a portion of the digital file, the printer comprising:

a light source capable of emitting ultraviolet light toward the imaging layer of the reimageable document, wherein a portion of the imaging layer is imagable by ultraviolet light emitted from the light source, wherein the portion of the imaging layer is movable from the clear state to the color state by ultraviolet light and forms a color contrast on the imaging layer, wherein the color contrast defines an image that is representative of the portion of the digital file; and a stylus emitting ultraviolet light, wherein a second portion of the imaging layer is movable from the clear state to the colored state via ultraviolet light emitted from the stylus, wherein the second portion forms a written image on the imaging layer of the reimageable document.

8. The system according to claim 7, wherein the portable printer is located remotely with respect to the central processing unit.

9. The system according to claim 7, the portable printer further comprising:

a heating source capable of emitting heat toward the imaging layer of the reimageable document, wherein heat from the heating source forms the color contrast on the imaging layer or erases the color contrast from the imaging layer.

10. The system according to claim 7, the portable printer further comprising:

an electric field source capable of applying an electrical field to the reimageable document, wherein an electrical field allows imaging of the imaging layer and erasing of the color contrast from the imaging layer.

11. The system according to claim 7, wherein the portable printer is integrated with the central processing unit into a portable computing device.

12. A method for printing one or more images to one or more reimageable documents, wherein the one or more images are representative of at least a portion of a digital file, the method comprising:

connecting a portable printer to a computing device;

emitting ultraviolet light from a light source of the portable printer onto a first portion of an imaging layer of the reimageable document that is imagable by ultraviolet light, wherein the ultraviolet light forms a color contrast on the imaging layer that defines an image representative of at least a portion of the digital file; and emitting a second ultraviolet light from a stylus onto a second portion of the imaging layer, wherein the second portion forms a written image on the imaging layer of the reimageable document.

13. The method according to claim 12, wherein the image formed by the color contrast is a transient image or a permanent image.

14. The method according to claim 12, further comprising: integrating the computing device and the printer into a portable computing device.

15. The method according to claim 12, further comprising: erasing the color contrast from the imaging layer of the reimageable document by heating the imaging layer or by exposing the imaging layer to visible light.

16. The method according to claim 15, further comprising: following the erasing, reimaging the imaging layer with ultraviolet light, wherein ultraviolet light forms another image indicative of the digital file onto the imaging layer.

17. The method according to claim 12, wherein the portable printer is located remotely with respect to the computing device.

18. The method according to claim 12, further comprising: modifying the color contrast formed on the imaging layer of the reimageable document with ultraviolet light.

19. The method according to claim 12, wherein the imaging layer is made of imaging material that is movable from a clear state to a colored state, wherein imaging material in the colored state defines the color contrast.

* * * * *